United States Patent [19]

Vertegaal

[11] 4,164,184

[45] Aug. 14, 1979

[54] COMPENSATING ROTARY SCREEN SUPPORTS

[75] Inventor: Jacobus G. Vertegaal, Boxmeer, Netherlands

[73] Assignee: Stork Brabrant B.V., Boxmeer, Netherlands

[21] Appl. No.: 782,291

[22] Filed: Mar. 28, 1977

Related U.S. Application Data

[63] Continuation of Ser. No. 633,154, Nov. 18, 1975, abandoned.

[30] Foreign Application Priority Data

Dec. 2, 1974 [NL] Netherlands ..... 7415717

[51] Int. Cl.[2] ..... B41F 15/38

[52] U.S. Cl. ..... 101/127.1; 101/128.1

[58] Field of Search ..... 101/127.1, 128.1

[56] References Cited

U.S. PATENT DOCUMENTS

| | | | |
|---|---|---|---|
| 3,837,277 | 9/1974 | Jaffa et al. | 101/127.1 |
| 3,971,313 | 7/1976 | Voegelin | 101/127.1 |

FOREIGN PATENT DOCUMENTS

| | | | |
|---|---|---|---|
| 288446 | 3/1971 | Austria | 101/128.1 |

*Primary Examiner*—Ronald E. Suter

*Attorney, Agent, or Firm*—Watson, Cole, Grindle & Watson

[57] ABSTRACT

A supporting structure for a stencil in a rotation screen printing machine. The stencil includes a thin-walled perforated cylinder having at both ends a ring secured via an annular connecting area to an extremity of the cylinder. The machine includes two opposite stationary parts each with an internal rotatable sleeve for connection with the end rings of the stencil, an aligning bearing within each part for supporting the sleeve, an universal joint element being provided in the supporting end structure of the stencil.

5 Claims, 9 Drawing Figures

COMPENSATING ROTARY SCREEN SUPPORTS

This application is a continuation of Ser. No. 633,154 filed Nov. 18, 1975, now abandoned.

BACKGROUND OF THE INVENTION

The invention relates to a rotary screen printing machine with a supporting structure for at least one cylindrical thin-walled stencil with two end rings which are each mounted to an end of the stencil via a circular connecting area. The structure includes two opposite stationary parts supported by the frame, a sleeve connected with an end ring of the associated stencil being rotatably supported in each part. Such a machine is known in various versions, as appears from U.S. Pat. Nos. 3,304,860, 3,675,571 and 3,718,086 as well as from copending patent applications Ser. No. 383,155, now U.S. Pat. No. 3,933,093 and Ser. No. 395,656, which has gone abandon and been replaced by a continuation-in-part application Ser. No. 608,268, now U.S. Pat. No. 3,420,167.

In such a machine the stencil, which consists of a thin-walled (±0.08 mm) perforated cylinder, is the most vulnerable element. Since the stencil is mounted in the machine under some axial tension (in order to achieve a greater rigidity of the thin wall) the frame in which the stencil is supported may be slightly deflected. Minor imperfections may also be present in the position of the two parts of the supporting structure, the centre-lines of which should be exactly coaxial. Due to these circumstances a varying load is applied to the stencil, whereby the life time is considerably shortened.

DISCUSSION OF THE PRIOR ART

Several suggestions have been made for improving the stencil suspension so that deformations in the frame of the machine and inaccurate positioning of the supported structure exert the least possible influence on the varying loads in the wall of the stencil. According to these proposals self-aligning bearings or a resiliently supported intermediate member are used.

Attempts have been made to attain a longer life time of the stencils by improving the precision of the connection between the stencil cylinder and the end ring at the two ends. This end ring is utilized so as to provide the stencil with a cylindrical shape and for securing the stencil to the machine. It has been found in practice that it is hardly possible to glue the end rings at right angles and parallel in the stencil sleeve. As a consequence, in spite of the use of the self-aligning or resilient suspension structure as mentioned above, a swinging movement of the stencil is still produced, which movement exerts an additional force on the stencil wall.

A further important consequence of the swinging movement of the stencil resides in the occurrence of a non-uniform circumferential speed, causing inaccuracies to arise in the register (the repeat) of the designs (the colours) of the consecutive stencils. Therefore a supporting structure has already been proposed which allows for compensation of imperfect gluing of the end rings. Reference can be made to copending patent application Ser. No. 582,814.

The suggestions in these earlier proposals have, however, not yet always been successful; that is to say: no stencil support has been proposed so far giving a life time to the stencil exclusively determined by wear caused by the sliding contact with the inner squeegee.

This may be explained by the fact that elimination of one imperfection does not remedy the other trouble and vice versa.

SUMMARY OF THE INVENTION

The present invention aims to provide a supporting structure which permits the stencils be perfectly aligned in such a manner that the centreline of each stencil, i.e., the imaginary centreline within the mounted stencil, independent of the occurrence of one or both of the aforementioned imperfections goes through the centre of the stationary supporting part of the machine. This is achieved according to my invention, by the combination of an aligning bearing between each sleeve and the stationary part in the frame of the machine, with means in the support of the ends of each stencil, allowing a universal tilting movement around a central point situated in the centre of the adjacent connecting area of the stencil and end ring. Due to these features it is ensured that the centre line of the stencil no longer swings or oscillates and does not undergo any lateral displacement.

In a preferred embodiment of the machine in conformity with the present invention the tilting means includes two cooperating complementary spherical surfaces in the connection of at least one of the sleeves with the relative end ring.

The present invention is also embodied in a supporting structure for an end of a stencil designed for the abovementioned rotary screen printing machine, which structure includes a part to be secured to the frame of the machine and a sleeve rotatably supported in that part. This supporting structure is distinguished by the combination of an aligning bearing between the sleeve and the fixed part in the frame of the machine and a spherical surface of a collar of the sleeve with a ring engaged about this collar. The ring is provided with a complementary spherical surface and with securing means for the end ring of a stencil.

SURVEY OF THE DRAWINGS

FIGS. 3 and 4 show a plan view and a side elevational view, of a supporting structure provided with a ball bearing with self adjusting outer ring in conformity with the state of the art;

DESCRIPTION OF THE PRIOR ART

Figure 1:
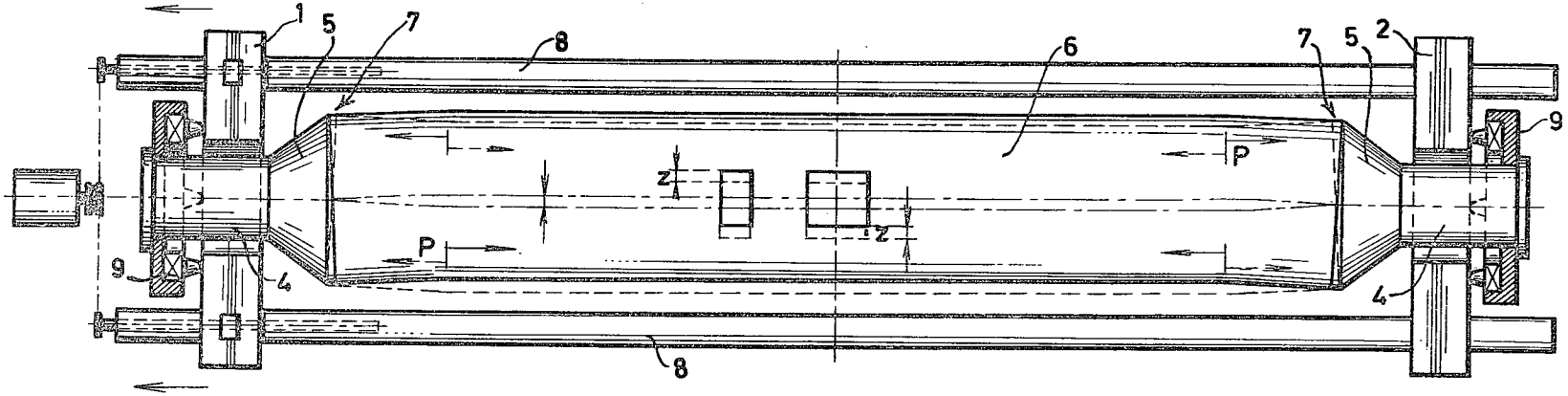
FIGS. 1 and 2 show a plan view and a front view, of a known supporting structure for a stencil.
Figure 2:
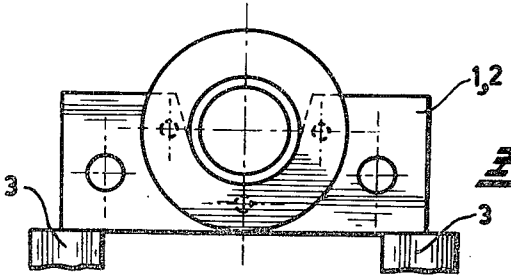

The embodiment according to FIG. 1 corresponds substantially to a previously used device described in copending patent application Ser. No. 108,394, subsequently abandoned and replaced by a continuation-in-part application, Ser. No. 394,645, now U.S. Pat. No. 3,892,176. The supporting structure consists of two opposite parts 1 and 2 supported by frame 3 (shown in FIG. 2) of the machine. In each supporting structure, a sleeve 4 is rotatably journalled, with the sleeve being connected with an end ring 5 of a stencil 6. Each end ring 5 is secured, via a circular connecting area 7, to the end of a stencil 6. Two rods are connected to the stationary part 2 of the supporting structure, for axially tensioning the stencil 6. Part 1 of the supporting structure is movable along the rods 8 in an axial direction. The rotatable sleeves 4 rest, via a bearing 9, upon the stationary part 2 of the supporting structure.

FIG. 1 shows in an exaggerated manner the imperfect mounting of each end ring 5 in the stencil 6. Owing to this inaccuracy a varying tension (P) is generated in the wall of the stencil 6, while further variations (z) occur at the location of the printed design, having a disturbing effect as to the quality of the final product. The location of this design now leads then lags with respect to the location aimed at, as a consequence of which the colours of the consecutive stencils no longer register exactly.

Figure 4:
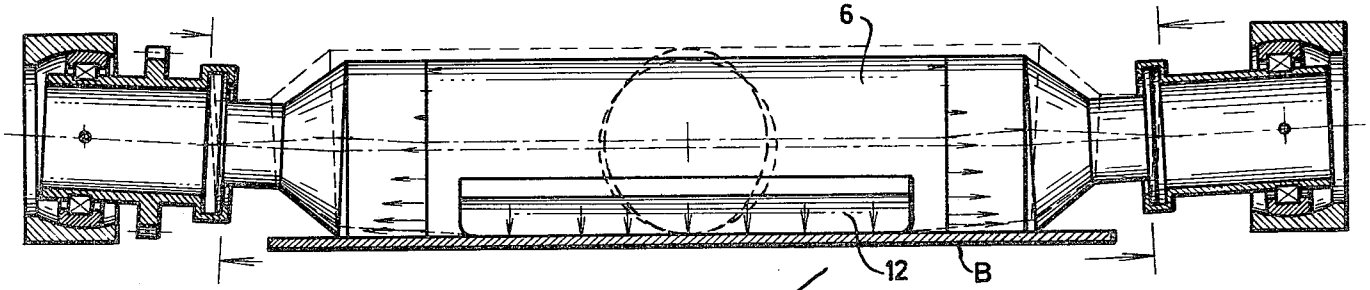
Figure 5:
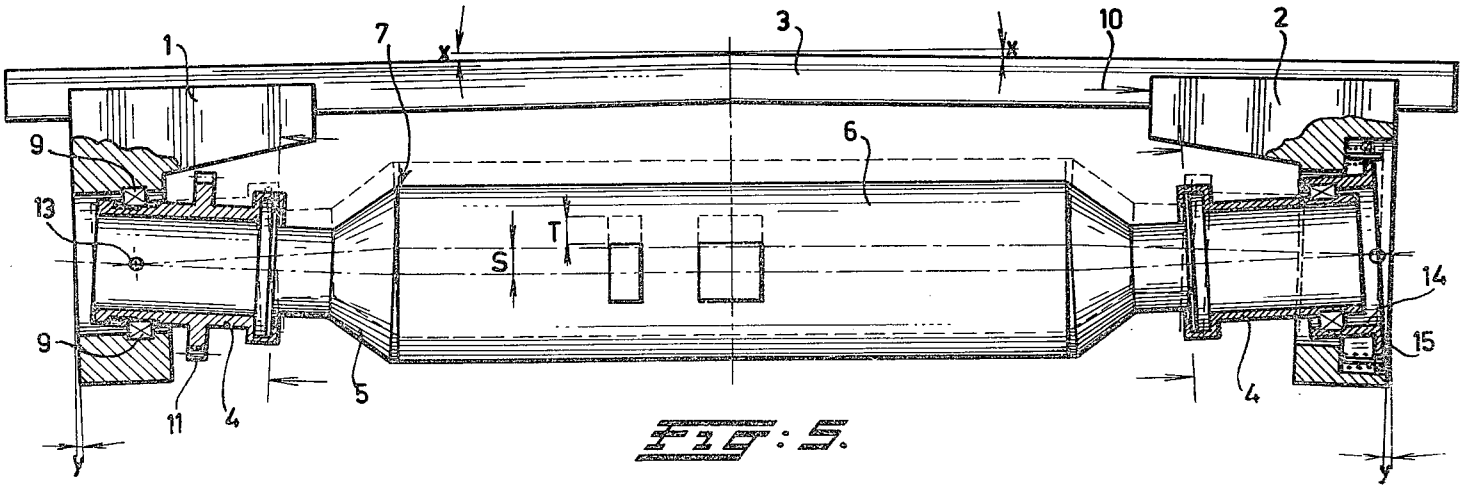

The embodiment according to FIGS. 3 and 4 shows a supporting structure in which the outer ring of the bearing 9' of the sleeve 4' is self-aligning in order to compensate deformations (x) of the frame 3' and incorrect aligning (y) of parts 1' and 2' of the supporting structure. End rings 5' support stencil 6. According to other imperfections however, a varying deviation (s) is occurring in the correct location of the stencil 6, so that also deviations (r) arise in the printed design.

It should be noted that in this embodiment parts 1' and 2' of the supporting structure are secured to a part of the frame 3', which is constructed as a bridge. The axial tensioning of the stencil 6 is effected by means of a resilient member 10, part 2' being slidable secured to the aforementioned bridge. Stencil 6 is driven on one side by means of the gear wheel 11 connected with the sleeve 4 represented left-ward in FIGS. 3 and 4. The latter Figure shows the inner squeegee 12 by which the dye paste within the stencil 6 is pressed on the band-shaped material disposed between this stencil and a supporting belt B moving along under this band. Each supporting part 1' and 2' of the machine has a centre 13.

Figure 5:
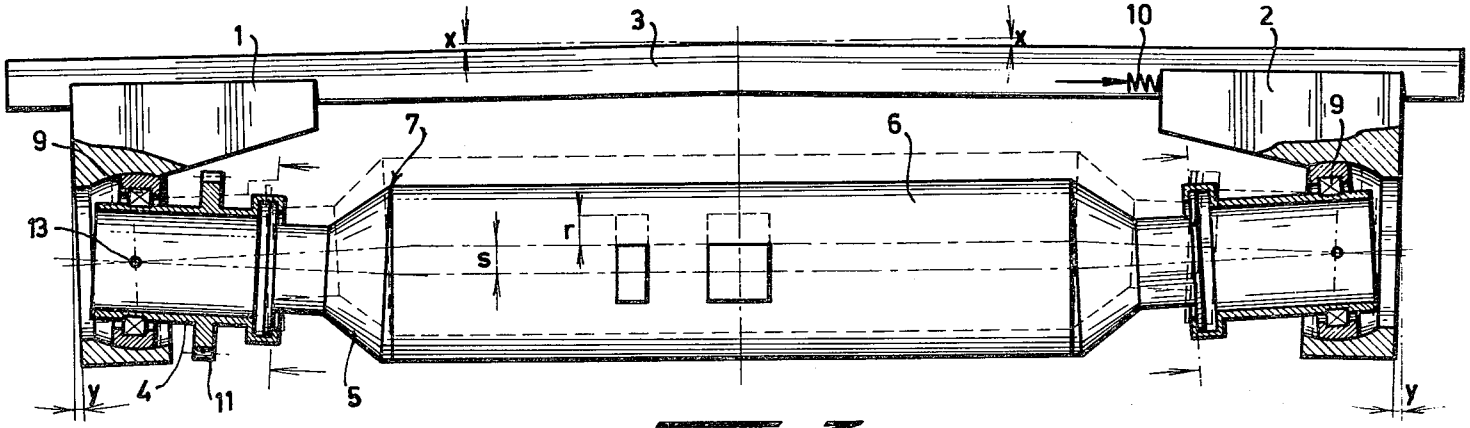
FIGS. 5 and 6 show likewise in plan view and in side elevational view a modification known per se of the supporting structure according to FIGS. 3 and 4.
Figure 6:
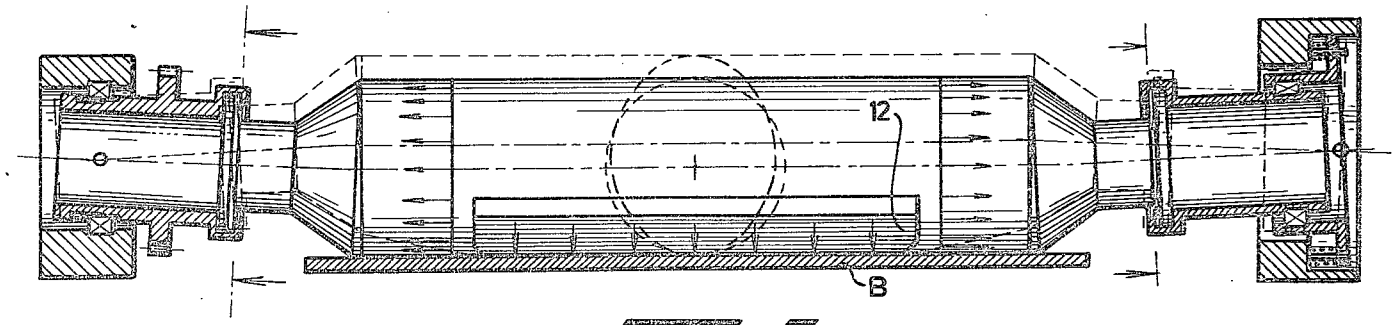

The embodiment according to FIGS. 5 and 6 corresponds substantially with that according to the two preceding Figures with the distinction, however, that the bearing 9'' on the left-hand side of these Figures allows a certain angular displacement of the sleeve 4'. On the right-hand side of these Figures the bearing 9'' is mounted in an intermediate member 14 provided with a radially protruding flange 15 which is resiliently secured in part 2' of the supporting structure.

DESCRIPTION OF PREFERRED EMBODIMENTS

Figure 7:
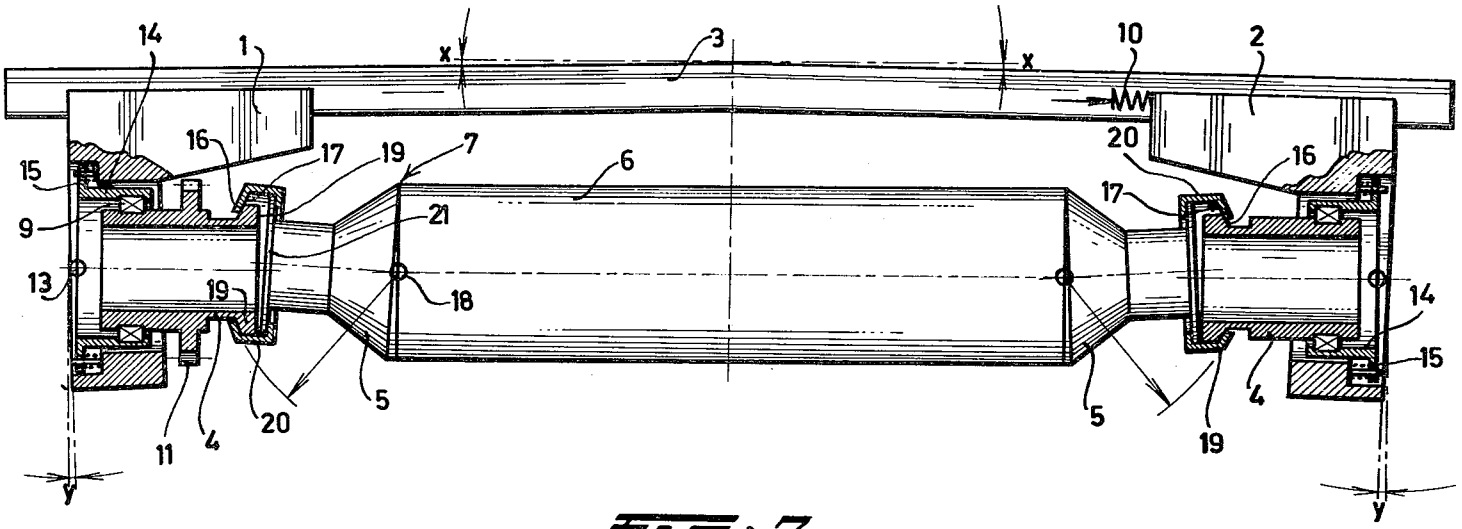
FIG. 7 is a plan view of the structure according to the present invention.

FIG. 7 represents the present invention. The connection of the sleeve 4a with the end ring 5a is in this case established by two complementary spherical surfaces 16 and 17 with a common centre 18 which is situated in the centre of the connecting area 7 of stencil and end ring. These spherical surfaces 16, 17 should, however on the driven (left-hand) side of the supporting structure be constructed in such a manner that a relative oscillation of the two surfaces with respect to the centre 18 is possible with the exclusion of a relative rotation around the centreline of the sleeve 4a or the end ring 5a.

The spherical surface 16 is provided on a collar 19 of the sleeve 4a. The spherical surface 17 cooperating therewith forms part of a ring 20 which is also engaged behind a fixing flange 21 of the end ring 5a concerned. The ring 20 can be easily detachably mounted to the flange 21 e.g. by means of a bayonet coupling (not shown). The bearing 9a is mounted in an intermediate member 14 provided with a flange 15 which is resiliently supported in the part 1' or the part 2' of the supporting structure.

The surfaces 16 and 17 constitute the means allowing a universal tilting movement of the end ring 5a with respect to the stencil 6. As a consequence it is possible to hold the centre line 22 of the stencil, in operation, in the same place, so that the harmful swinging or oscillatory movement is prevented. The axial tension in the stencil wall remains uniformly distributed on the circumference of the stencil and a varying load is prevented from being set up. The centreline 22 of the stencil will always be located in such a manner that the produced part of this centreline goes through the centre 13 of the supporting part 1' or 2'. These effects of the invention contribute to the obtainment of an exact printing result and to a long life time of the stencils.

Figure 8:
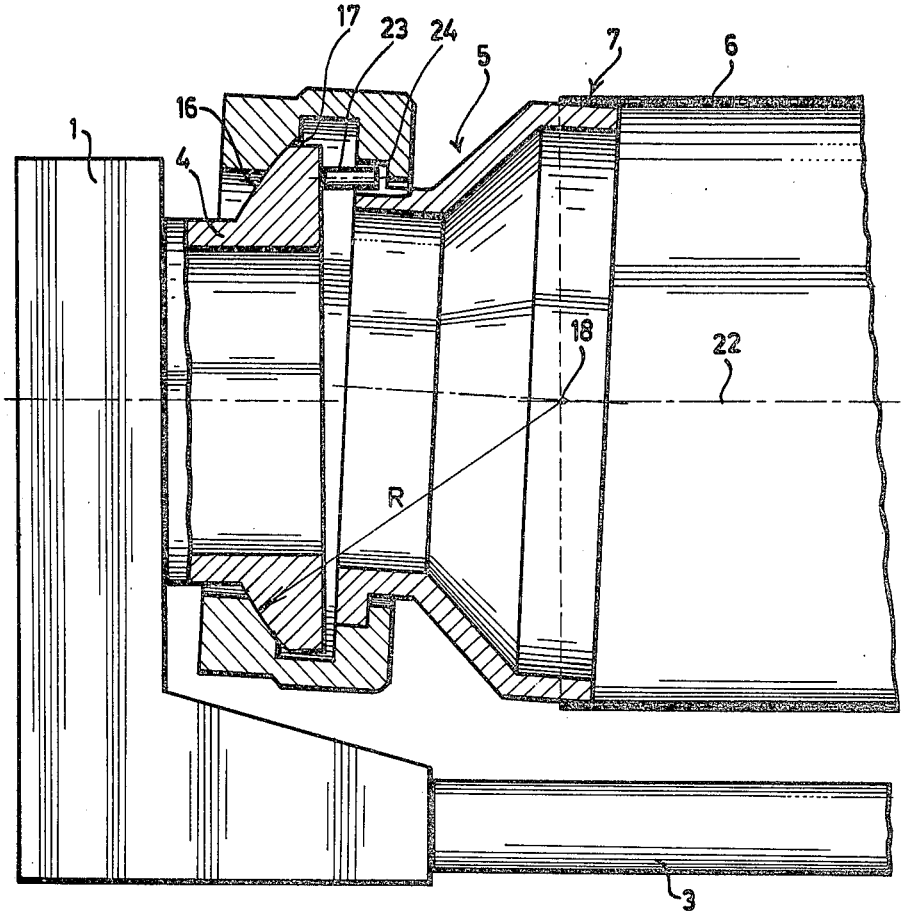
FIG. 8 is an axial section on a larger scale of the end ring of a stencil according to FIG. 7.

FIG. 8 shows a realization of the stencil support according to FIG. 7, a pin 23 of the sleeve 4b engaging a recess 24 of ring so mounted on end of the end ring 5b.

Figure 9:
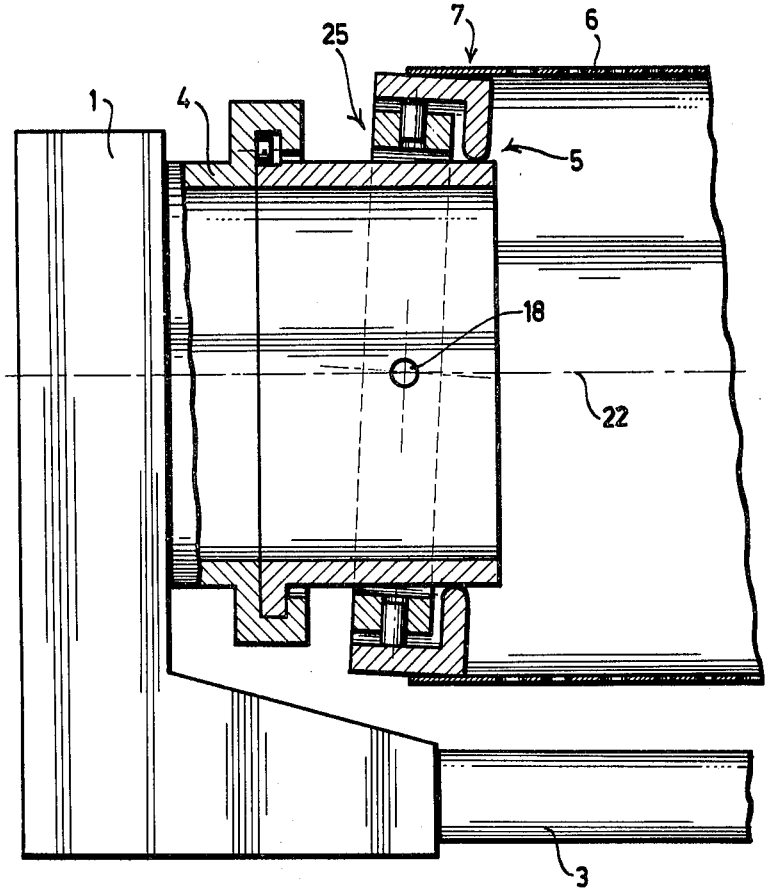
FIG. 9 illustrates in a way analogous to that of FIG. 8 the end of a stencil with another connecting member.

According to FIG. 9 the tilting means or the connecting member consist of a universal joint 25. The end ring 5c consists here of three coaxial parts the innermost part of which is coupled to the sleeve 4c.

It is essential for the present invention that compensation is provided for inaccuracies in the mounting or in the support, of the stencils. This compensation is based on the adjustability of the sleeve in the frame in combination with a possibility of tilting to all sides between the parts of the end ring, while the centre of the connecting area of the stencil and end ring is the centre of tilt. In the embodiment according to the FIGS. 7–9 this is achieved by a sliding or pivotal movement. It is also possible to use a plastic deformation in conformity with the above mentioned copending patent application Ser. No. 582,814.

What I claim is:

1. Improvement in a rotary screen printing machine with a supporting structure mounted on a frame of the machine for supporting at least one cylindrical stencil having two end rings each being mounted to a respective end the stencil via a circular connecting area, the supporting structure comprising:

two stationary members supported by said frame, said stationary members being arranged so as to be positioned on opposite sides of a supported stencil;

two sleeves, each coupled to a respective one of said stationary members and connected with a respective end ring of the stencil;

the improvement comprising the combination of:

self-aligning bearings between each stationary member and each sleeve for rotatably supporting the stencil; and universal coupling means between the end rings of the stencil and said sleeves so as to allow the end rings to undergo a universal tilting movement about a central point in the connecting area of the stencil with each of its end rings so that the centre line of the stencil is free of lateral displacement, said universal coupling means formed by the provision of complementary cooperating spherical surfaces on each of said sleeves and the corresponding said end ring of said stencil in the area of the connection between said sleeve and said end ring.

2. A machine as defined in claim 1, wherein said sleeve has a collar portion; one of said spherical surfaces is formed on said collar portion of each of said sleeves and the other cooperating spherical surface is formed on a further ring member coupled to each said end ring.

3. A machine as defined in claim 1, wherein each of said stationary members includes a resiliently mounted member coaxial with said sleeve and positioned between said sleeve and said stationary member.

4. A structure for supporting a cylindrical stencil having rings at both ends, and adapted to be mounted on a frame of a rotary screen printing machine, the supporting structure comprising:

first and second stationary members each including means for securing the members to the frame of the machine;

first and second sleeves rotatably supported on said first and second stationary members, respectively, each said sleeve having a collar with a spherical surface;

a further ring coupled to each end ring of the stencil, said further ring having a spherical surface, such spherical surface being complementary with said spherical surface of said collar of the associated said sleeve; and means for coupling each said further rings to a corresponding collar with their spherical surfaces mating with each other, so as to allow said end rings to undergo a universal tilting movement about a central point in the connecting area of the stencil with each of its end rings so that the centre line of the stencil is free of lateral displacement.

5. A supporting structure as defined in claim 4, further comprising: an aligning bearing provided between each said sleeve and the associated said stationary member.

* * * * *